US006628060B2

(12) United States Patent
Shimizu et al.

(10) Patent No.: US 6,628,060 B2
(45) Date of Patent: Sep. 30, 2003

(54) COLOR CATHODE RAY TUBE

(75) Inventors: Norio Shimizu, Fukaya (JP); Masatsugu Inoue, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 16 days.

(21) Appl. No.: 10/083,577

(22) Filed: Feb. 27, 2002

(65) Prior Publication Data

US 2002/0158564 A1 Oct. 31, 2002

(30) Foreign Application Priority Data

Feb. 28, 2001 (JP) ..... 2001-054701

(51) Int. Cl.[7] ..... H01J 29/80
(52) U.S. Cl. ..... 313/408
(58) Field of Search ..... 313/402–3, 408, 313/461, 477 R

(56) References Cited

U.S. PATENT DOCUMENTS 6,333,594 B1 12/2001 Nakagawa et al.

FOREIGN PATENT DOCUMENTS

JP 11-242940 9/1999
JP 2000-149809 5/2000
JP 3137621 12/2000

*Primary Examiner*—Sandra O'Shea
*Assistant Examiner*—Sumati Krishnan
(74) *Attorney, Agent, or Firm*—Oblon, Spivak, McClelland, Maier & Neustadt, P.C.

(57) ABSTRACT

A color cathode ray tube comprises a face panel having a phosphor screen formed on the inner surface thereof and a shadow mask. A mask body of the shadow mask has an effective surface opposed to the phosphor screen and formed having a plurality of electron beam passage apertures. The face panel and mask body are formed so as to establish relations:

ZPD>ZPV>ZPH,

ZMD>ZMH>ZMV,

ZPD<ZMD,

ZPH<ZMH, and

ZPV>ZMV, where ZPD, ZPH, and ZPV are sags at a diagonal-axis end, horizontal-axis end, and vertical-axis end, respectively, with respect to the center of the inner surface of the face panel, and ZMD, ZMH, and ZMV are sags at the individual axis ends with respect to the center of the effective surface of the mask body.

10 Claims, 4 Drawing Sheets

COLOR CATHODE RAY TUBE

CROSS-REFERENCE TO RELATED APPLICATIONS

This application is based upon and claims the benefit of priority from the prior Japanese Patent Application No. 2001-054701, filed Feb. 28, 2001, the entire contents of which are incorporated herein by reference.

BACKGROUND OF THE INVENTION

The present invention relates to a color cathode ray tube having a shadow mask.

In general, a color cathode ray tube comprises a vacuum envelope that includes a substantially rectangular face panel and a funnel. The face panel includes an effective portion formed of a curved surface and a skirt portion set up on the peripheral part of the effective portion. The funnel is fixed to the skirt portion. A phosphor screen is formed on the inner surface of the effective portion of the face panel. The phosphor screen includes black non-luminous layers and three-color phosphor layers that are embedded individually in gaps between the non-luminous layers. Inside the face panel, moreover, a substantially rectangular shadow mask is opposed to the phosphor screen.

An electron gun that emits three electron beams is located in a neck of the funnel. The color cathode ray tube displays a color image in a manner such that the three electron beams are deflected by means of magnetic fields that are generated by means of a deflection yoke on the outside of the funnel, and that the phosphor screen is scanned horizontally and vertically with the electron beams that are passed through the shadow mask.

The shadow mask includes a substantially rectangular press-molded mask body and a substantially rectangular mask frame that is attached to the peripheral part of the mask body. The mask body has an effective surface formed of a curved surface that is opposed to the phosphor screen, and a large number of electron beam passage apertures are formed in the effective surface. The shadow mask is detachably supported on the inside of the face panel in a manner such that elastic supports attached to the respective middle portions of the side faces of the mask frame or to the outside of its corner portions are anchored to stud pins on the skirt portion of the face panel.

In order to display an image without a color purity drift on the phosphor screen, the three electron beams that pass through the electron beam passage apertures of the mask body must be landed correctly on the three-color phosphor layers. To attain this, it is necessary to keep the relative positions of the face panel and the shadow mask correct, and in particular, to keep the space (q-value) between the inner surface of the effective portion of the face panel and the effective surface of the mask body within a given tolerance.

In a modern color cathode ray tube, the outer surface of the effective portion of the face panel is expected to be formed into a flat surface or a curved surface that, having a radius of curvature of 10 m or more, is as flat as possible. Corresponding to this, the respective radii of curvature of the inner surface of the effective portion and the effective surface of the mask body must be increased.

If the mask body is press-molded so that the radius of curvature of its effective surface is increased, however, its curved surface retention lowers. In consequence, the mask body may be deformed substantially to lower the color purity of the color cathode ray tube during manufacturing processes for the tube.

If the radius of curvature of the inner surface of the face panel and the radius of curvature of the shadow mask are lessened to avoid this, the difference in thickness between the central and peripheral parts of the panel becomes so great that the manufacture of the face panel itself is rendered difficult. Further, this situation results in lowering of visibility, such as diminution of the visual angle, distortion of an image reflected by the inner surface of the face panel, etc. Preferably, therefore, it is desirable that the radius of curvature of the inner surface of the face panel is enlarged.

According to a color cathode ray tube described in Jpn. Pat. Appln. KOKAI Publication No. 11-242940, for example, the inner surface of the effective portion of the face panel is shaped so that it has a given curvature in the minor-axis direction, a substantially infinite radius of curvature in the major-axis direction near its center, and a given curvature near its peripheral edge. According to this configuration, the curved surface strength of the mask body can be improved, and besides, the atmospheric-pressure strength of the vacuum envelope can be enhanced.

In the color cathode ray tube described in this publication, however, the strength of the mask body near the center and the minor-axis end is still lower than the strength at the peripheral part. This phenomenon is particularly conspicuous in a color cathode ray tube with an aspect ratio of 16:9.

In flattening the face panel, its curved surface changing rate, that is, a ratio of a sag of the effective surface of the panel at a position distant from the center of the effective surface to the distance of the position from the center of the effective surface, must be adjusted to at least 0.02 or more, in consideration of the atmospheric-pressure strength and implosion-proof performance. In this application, a sag represents the deference between the level at a position of the face panel or the shadow mask and the level at the center of the face panel or the shadow mask in the tube axis direction.

Further, the color cathode ray tube described in the aforesaid publication has a problem on the quality level of the phosphor screen. In general, the phosphor screen of a color cathode ray tube is formed by photolithography. In this method, phosphor slurry that consists mainly of a phosphor material and a photosensitive resin is spread over the inner surface of the face panel and dried, whereupon a phosphor slurry layer is formed. This phosphor slurry layer is exposed through a shadow mask and then developed, whereupon a phosphor layer is formed. The phosphor screen is formed by repeating these processes for each of three color phosphor layers.

In the exposure process, light from an exposure light source is approximated to the respective trajectories of the three electron beams from the electron gun by means of an optical lens system, and the phosphor slurry layer is exposed so that the phosphor layer is formed in a predetermined position relative to the electron beam passage apertures of the shadow mask.

In an in-line color cathode ray tube, the three-color phosphor layers or black non-luminous layers are formed as elongate stripes that extend in the minor-axis direction of the face panel. The shadow mask has a large number of slit-shaped electron beam passage apertures, which are arranged so that a large number of electron beam passage aperture lines extend along the minor axis.

In the case where the phosphor screen of the in-line color cathode ray tube with the configuration described in the aforementioned publication is formed in the aforesaid method, a meandering phenomenon called light source bending occurs, since the middle portion of the inner surface of the face panel in the major-axis direction has a substantially infinite radii of curvature in the major-axis direction and a given curvature only in the minor-axis direction. In consequence, the phosphor layers fail to be straight and meander especially near the middle portion of each long side of the phosphor screen. The image quality level lowers in this case.

BRIEF SUMMARY OF THE INVENTION

The present invention has been contrived in consideration of these circumstances, and its object is to provide a color cathode ray tube, of which the shadow mask strength and the display quality level can be improved without failing to ensure the flatness of a face panel.

In order to achieve the above object, a color cathode ray tube according to an aspect of the invention comprises: an envelope including a face panel having a substantially rectangular effective portion with a substantially flat outer surface; a phosphor screen provided on the inner surface of the effective portion; an electron gun configured to emit electron beams to the phosphor screen; and a shadow mask located between the phosphor screen and the electron gun. The shadow mask includes a mask body having a substantially rectangular effective surface opposed to the inner surface of the effective portion of the face panel and formed having a large number of electron beam passage apertures. The effective portion of the face panel and the effective surface of the mask body have a major axis perpendicular to a tube axis, a minor axis perpendicular to the tube axis and the major axis, and a diagonal axis perpendicular to the tube axis.

Sags of the inner surface of the effective portion of the face panel in the direction of the tube axis toward the electron gun at the ends of each axis with respect to the center of the inner surface of the effective portion have relations:

$$ZPD>ZPV>ZPH,$$

where ZPD is a sag at the diagonal-axis end of the effective portion, ZPH is a sag at the major-axis end, and ZPV is a sag at the minor-axis end. Sags of the effective surface of the shadow body in the direction of the tube axis toward the electron gun at the ends of each axis with respect to the center of the effective surface have relations:

$$ZMD>ZMH>ZMV,$$

where ZMD is a sag at the diagonal-axis end of the effective surface, ZMH is a sag at the major-axis end, and ZMV is a sag at the minor-axis end. The sags have relations:

$$ZPD<ZMD,$$

$$ZPH<ZMH,$$

and $$ZPV>ZMV.$$

A color cathode ray tube according to another aspect of the invention comprises: an envelope including a face panel having a substantially rectangular effective portion with a substantially flat outer surface; a phosphor screen provided on the inner surface of the effective portion; an electron gun configured to emit electron beams to the phosphor screen; and a shadow mask located between the phosphor screen and the electron gun. The shadow mask includes a mask body having a substantially rectangular effective surface opposed to the inner surface of the effective portion of the face panel and formed having a number of electron beam passage apertures. The effective portion of the face panel and the effective surface of the mask body have a major axis perpendicular to a tube axis, a minor axis perpendicular to the tube axis and the major axis, and a diagonal axis perpendicular to the tube axis.

Sags of the inner surface of the effective portion of the face panel in the direction of the tube axis toward the electron gun at the ends of each axis with respect to the center of the inner surface of the effective portion; the distances from the center of the inner surface of the effective portion to the individual axis ends; Sags of the effective surface of the shadow body in the direction of the tube axis toward the electron gun at the ends of each axis with respect to the center of the effective surface; and the distances from the center of the effective surface of the mask body to the individual axis ends have relations:

$$0.020<Z/L<0.060,$$

and $$0.025<Z'/L'<0.090,$$

where Z/L and Z'/L' represent ZPD/LPD, ZPH/LPH, or ZPV/LPV and ZMD/LMD, ZMH/LMH, or ZMV/LMV, respectively, ZPD, ZPH, and ZPV representing sags of the inner surface of the effective portion at the diagonal-axis end, major-axis end, and minor-axis end, respectively, of the effective portion of the face panel with respect to the center of the inner surface of the effective portion, LPD, LPH, and LPV representing the distances from the center of the inner surface of the effective portion to the diagonal-axis end, major-axis end, and minor-axis end, respectively, of the effective portion, ZMD, ZMH, and ZMV representing sags at the diagonal-axis end, major-axis end, and minor-axis end, respectively, of the effective surface of the mask body with respect to the center of the effective surface, and LMD, LMH, and LMV representing the distances from the center of the effective surface of the mask body to the diagonal-axis end, major-axis end, and minor-axis end, respectively, of the effective surface.

By setting the respective curvatures of the mask body and the inner surface of the face panel in this manner, deformation of the mask body that may be caused during manufacturing processes or by external shock can be prevented despite the flatness of the outer surface of the face panel, and lowering of color purity that is attributable to errors in beam landing can be lessened. Thus, the resulting color cathode ray tube can enjoy improved display quality. Further, the implosion-proof performance and visibility can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

A color cathode ray tube according to an embodiment of the present invention will now be described in detail with reference to the accompanying drawings.

Figure 1:
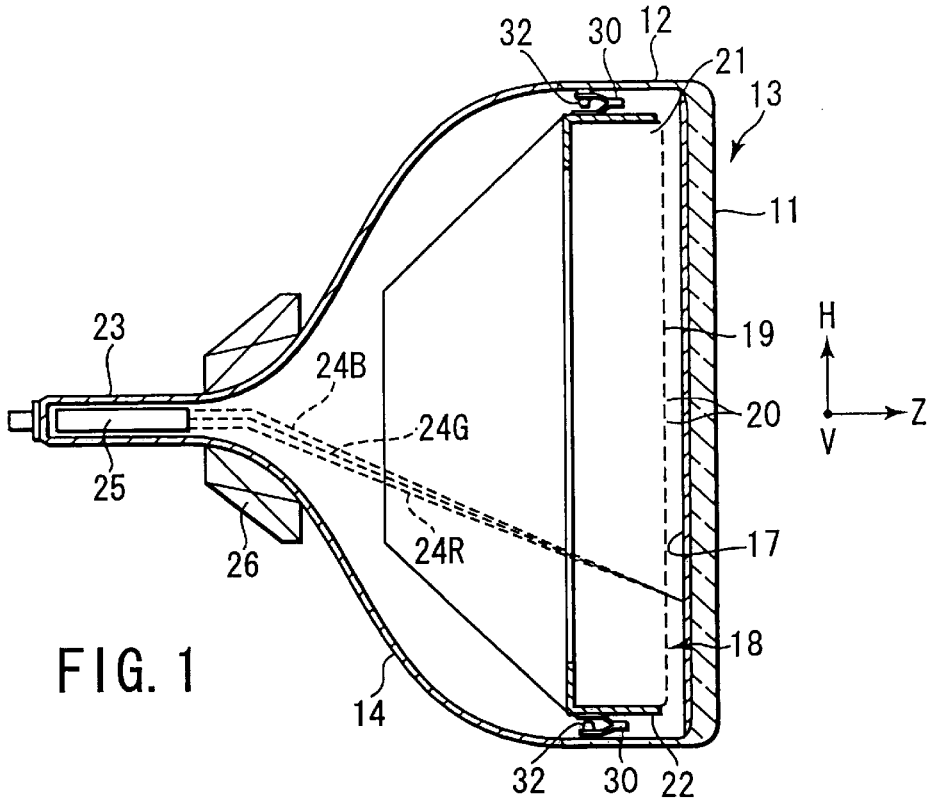
FIG. 1 is a sectional view of a color cathode ray tube according to an embodiment of the invention.
Figure 2:
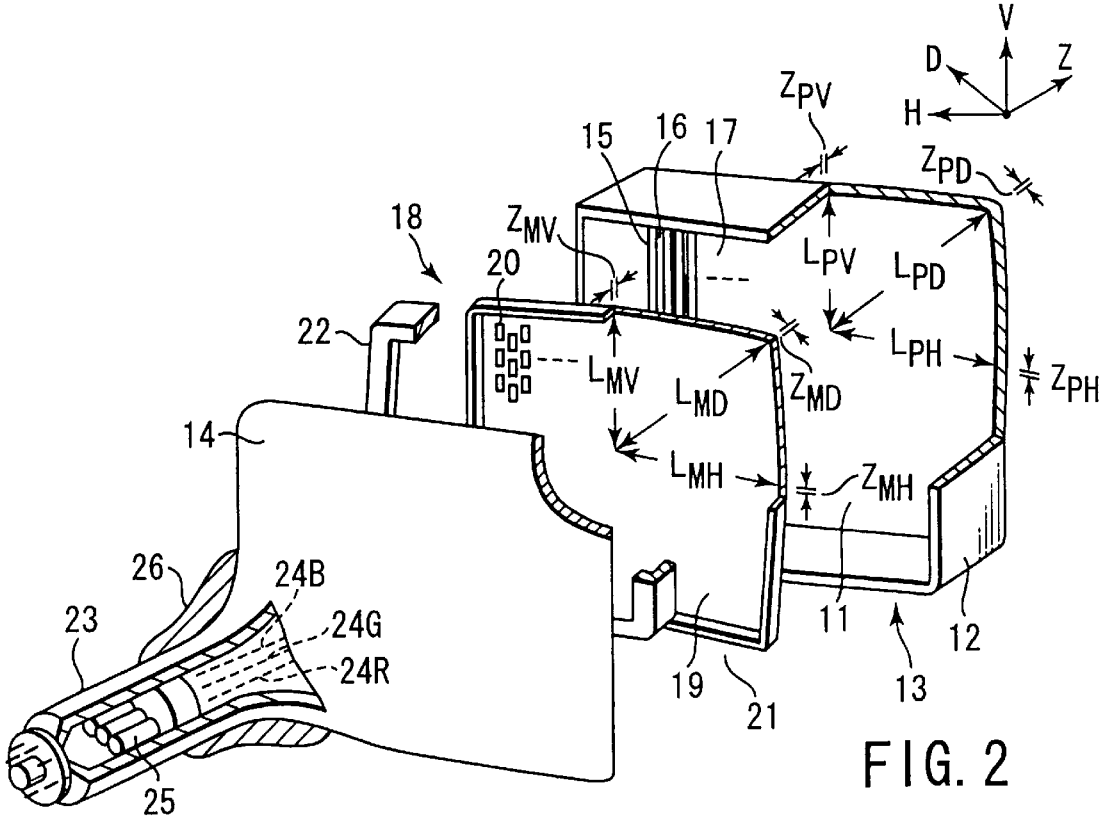
FIG. 2 is an exploded perspective view showing the color cathode ray tube.

As shown in FIGS. 1 and 2, the color cathode ray tube comprises a vacuum envelope that includes a substantially rectangular face panel 13 and a funnel 14. The face panel 13 includes an effective portion 11 formed of a curved surface and a skirt portion 12 set up on the peripheral part of the effective portion. The funnel 14 is fixed to the skirt portion 12. A phosphor screen 17 is provided on the inner surface of the effective portion 11 of the face panel 13. The phosphor screen 17 includes black non-luminous layers 15 and three-color phosphor layers 16 that are embedded individually in gaps between the non-luminous layers. Inside the face panel 13, moreover, a substantially rectangular shadow mask 18 is opposed to the phosphor screen 17.

The shadow mask 18 comprises a substantially rectangular press-molded mask body 21 and a substantially rectangular mask frame 22 that is attached to the peripheral part of the mask body. The mask body 21 has an effective surface 19 formed of a curved surface that is opposed to the phosphor screen 17, and a large number of slit-shaped electron beam passage apertures 20 are formed in the effective surface. The shadow mask 18 is detachably supported on the inside of the face panel 13 in a manner such that elastic supports 30 attached to the respective middle portions of the side faces of the mask frame 22 are anchored to stud pins 32 on the skirt portion 12 of the face panel 13, for example.

An electron gun 25 that emits three electron beams 24B, 24G and 24R is arranged in a neck 23 of the funnel 14. The color cathode ray tube displays a color image in a manner such that the three electron beams 24B, 24G and 24R emitted from the electron gun 25 are deflected by magnetic fields that are generated by means of a deflection yoke 26 on the outside of the funnel 14, and that the phosphor screen 17 is scanned horizontally and vertically with the electron beams that are passed through the shadow mask 18.

The face panel 13 and the shadow mask 18 of the color cathode ray tube have a major axis H perpendicular to a tube axis Z, a minor axis V perpendicular to the major axis and the tube axis, and a diagonal axis D. In this case, the phosphor layers 16 and black non-luminous layers 15 of the phosphor screen 17 are in the form of an elongate stripe each, extending in the direction of the minor axis V. Corresponding to this, in the shadow mask 18, a large number of aperture lines of electron beam passage apertures 20 that extend along the minor axis V are arranged side by side in the direction of the major axis H.

Figure 3:
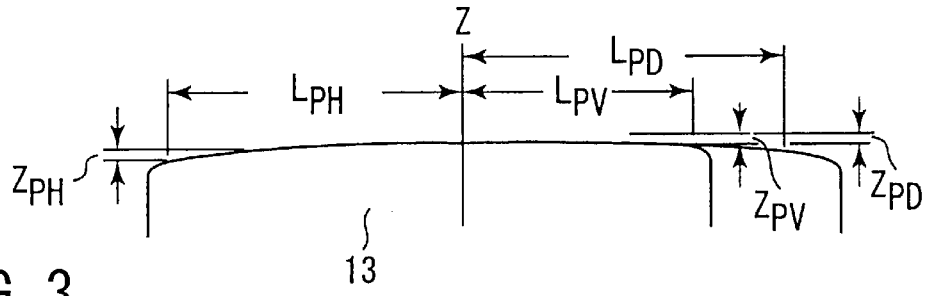
FIG. 3 is a view typically showing the shape of the inner surface of a face panel effective portion of the color cathode ray tube.

The following is a description of an example of the color cathode ray tube of this type, of which the effective diagonal dimension of the picture is 60 cm, the aspect ratio is 4:3, and the radius of curvature of the outer surface of the face panel 13 is 10 m. As shown in FIGS. 2 and 3, for the inner surface of the effective portion 11 of the face panel 13, the length from the tube axis Z to the H-axis end, the length from the tube axis Z to the V-axis end, and the length from the tube axis Z to the D-axis end are supposed to be LPH, LPV and LPD, respectively. For the effective portion 11 of the inner surface of the face panel 13 and the effective surface 19 of mask body 21, moreover, a z-axis direction space (distance) between the center portion and each axis end portion is defined as a sag.

If sags toward the electron-gun-side at the diagonal-axis D end, major-axis H end, and minor-axis V end of the inner surface of the effective portion 11, with respect to the center of the inner surface of the effective portion 11 or the point of intersection of the tube axis Z and the inner surface of the face panel 13, are ZPD, ZPH, and ZPV, respectively, they have relations:

$$ZPD>ZPH>ZPV$$

in a conventional color cathode ray tube having a curved outer surface. In the color cathode ray tube of the present embodiment, on the other hand, the sags have relations:

$$ZPD>ZPV>ZPH$$

If the outer surface of the face panel 13 is flattened so that its radius of curvature is 10 m, the curvature of the inner surface of the face panel 13 must be minimized in consideration of visibility based on flatness, tube face color, etc. The result of an implosion-proof property test shown in TABLE 1 indicates that the curved surface changing rate of the face panel 13 should be at least 0.02 or more, and that the implosion-proof properties are generally lowered to the extremity in a region near the effective dimension end in the V-axis direction.

TABLE 1

| Curved surface changing rate | 0 | 0.02 | 0.04 | 0.06 | 0.08 |
|---|---|---|---|---|---|
| Implosion-proof properties | X | X–Δ | ○ | ○ | ○ |

By establishing the aforesaid relations between the sags at the individual axis ends of the inner surface of the panel effective portion 11, therefore, the thickness distribution of the face panel 13 can be rationalized to improve the implosion-proof properties in a manner such that the curvature of the region near the effective dimension end in the V-axis direction is relatively increased while the curvature of the inner surface of the effective portion 11 is minimized.

Figure 4:
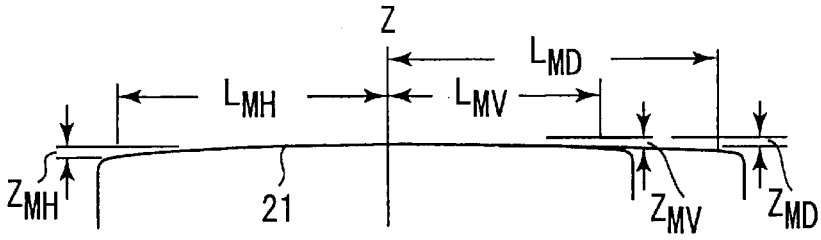
FIG. 4 is a view typically showing the shape of an effective surface of the mask body of a shadow mask.

For the mask body 21, on the other hand, the length from the tube axis Z to the H-axis end, the length from the tube axis Z to the V-axis end, and the length from the tube axis Z to the D-axis end are supposed to be LMH, LMV and LMD, respectively, as shown in FIG. 4. In this case, if sags toward the electron-gun-side at the diagonal-axis D end, major axis H end, and minor axis V end of the effective surface 19, with respect to the center of the mask body 21, are ZMD, ZMH, and ZMV, respectively, they have relations:

$$ZMD>ZMH>ZMV.$$

Figure 5:
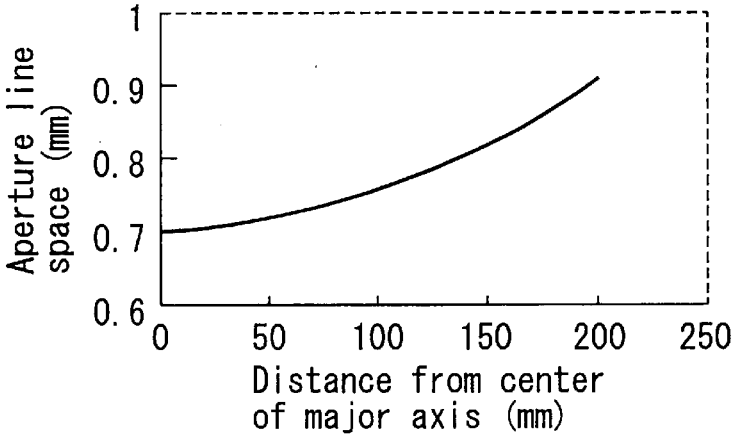
FIG. 5 is a diagram showing the relation between the space between lines of electron beam passage apertures in the mask body and the distance from the center of a major axis.
Figure 6:
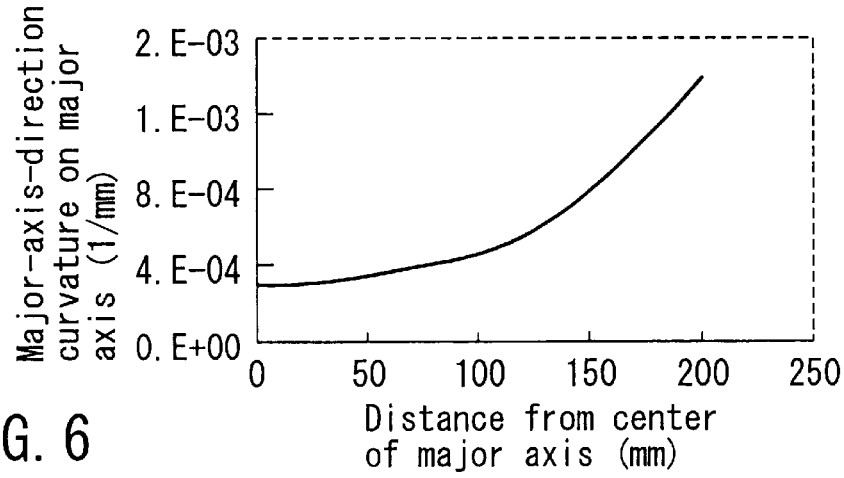
FIG. 6 is a diagram showing change of curvature along the major axis of the mask body.

This implies that the spaces between the electron beam passage apertures 20 in the major-axis H direction are enlarged on the major axis H from the central part of the effective surface 19 toward each short side, as shown in FIG. 5. In consequence, the curvature of the mask body in the major-axis H direction on the major axis H increases toward the periphery of the effective surface 19, as shown in FIG. 6, and the sag ZMH at the major-axis H end portion of the effective surface 19 is greater than the sag at the central part of the effective surface 19. Thus, the strength of the curved surface of the mask body 21 can be improved. This sag is set substantially in the same manner for each long side of the effective surface 19, and the sag ZMD at the diagonal axis D end of the effective surface is also set to be greater.

The curved surface strength of the mask body 21 can be further improved by establishing relations $$ZPD<ZMD$$

and $$ZPH<ZMH$$

between the respective sags of the mask body 21 and the face panel 13. At the same time, the maintenance of the visibility of the face panel 13 can be reconciled with the improvement of the implosion-proof properties of the color cathode ray tube.

Further, the curvature of the mask body 21 can be increased by establishing ZPV>ZMV so that the curvature of the face panel 13 is maximized on the minor axis V. Thus, the curved surface strength of the face panel 13 can be improved.

Figure 7:
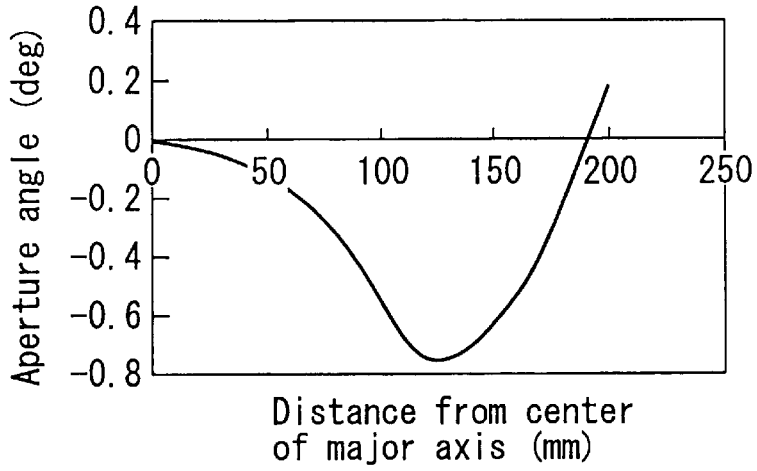
FIG. 7 is a diagram showing change of the tilt angle of each electron beam passage aperture along the major axis of the mask body.

At the minor-axis V end portion, the spaces between the electron beam passage apertures 20 of the mask body 21 are narrowed in a manner such that the q-value is lowered by relatively reducing the sag of the effective surface of the mask body 21 with respect to the curved surface of the effective portion of the face panel 13. In the mask body 21 that has the slit-shaped electron beam passage apertures 20 elongated along the minor axis V, moreover, the tilt angle of the longitudinal axis of each electron beam passage aperture 20 to a direction parallel to the minor axis V has a positive value such that the opening edge of the aperture on the long side of the mask body 21 is farther from the minor axis V than the opening edge of the aperture on the major axis side, or on the opposite side is. As shown in FIG. 7, the respective tilt angles of the electron beam passage apertures 20 situated in the long side portions of the mask body 21, except those ones at the diagonal-axis D end portion of the mask body, are negative.

Figure 8:
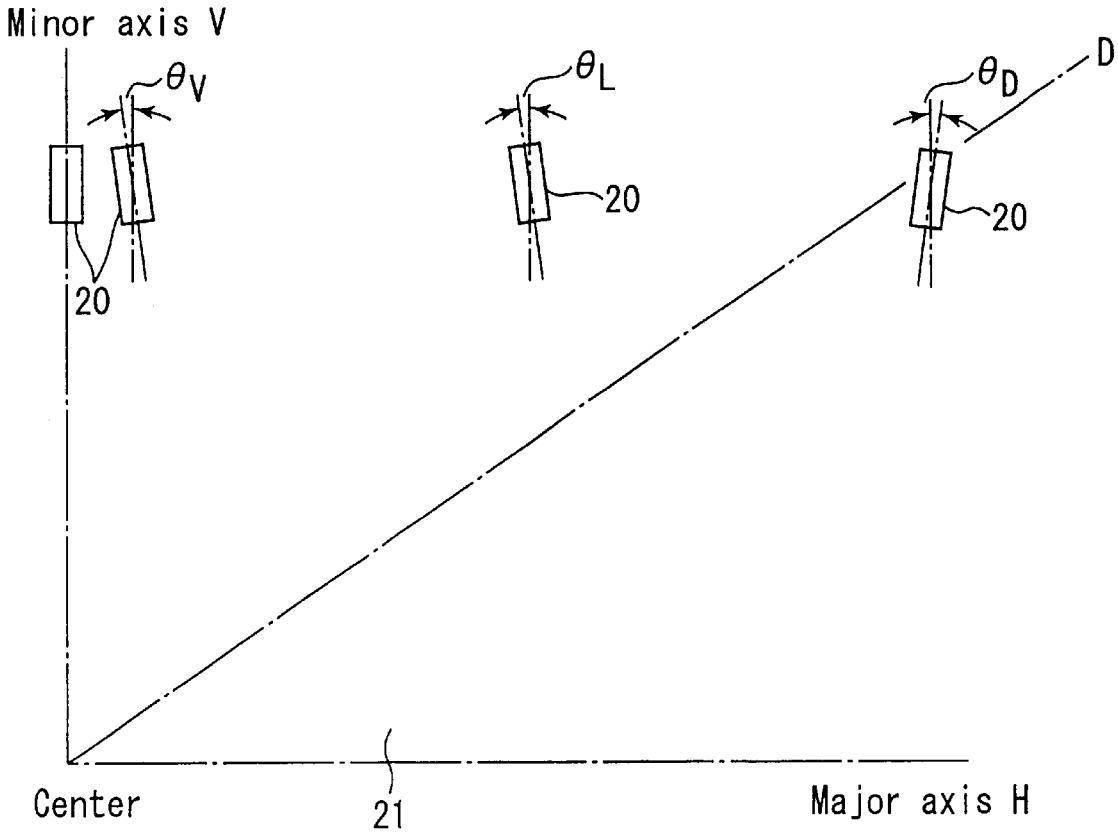
FIG. 8 is a diagram for illustrating the tilt angle of each electron beam passage aperture in the mask body.

More specifically, as shown in FIG. 8, each electron beam passage aperture 20 on the minor axis V, among other electron beam passage apertures in the mask body 21, has its longitudinal axis parallel to the minor axis V. Each electron beam passage aperture 20 that is situated at a short distance from the minor axis V is tilted at a negative angle $\theta_V$ to the minor axis. If the tilt angle of each electron beam passage aperture 20 situated at a distance half the distance between the minor-axis V end and the diagonal-axis D end from the minor-axis V end on the diagonal-axis D end side, on each long side of the mask body 21, and the tilt angle of each electron beam passage aperture 20 situated near the diagonal-axis D end are θL and θD, respectively, the tilt angles $\theta_V$ and θL have relations $0 \geqq \theta_V > \theta L$ such that the tilt angle θL is narrower than the tilt angle $\theta_V$ that is equal to or smaller than 0. The tilt angle θD is adjusted to θD>0 such that the electron beam passage aperture 20 is tilted at a positive angle to the minor axis V.

In this case, meandering of the stripes that are formed of the non-luminous layers 15 and the phosphor layers 16 of the phosphor screen 17, which is caused mainly by light source bending in the middle portion on each long side of the mask body 21, can be restrained.

The tilt angle of each electron beam passage aperture described herein is the angle of an image that is formed as the electron beam passage aperture of the shadow mask is projected on a flat surface parallel to the face panel surface.

In the region near the diagonal axis D end portion of the mask body 21, moreover, the light source bending can be corrected by increasing the sag ZMD and the curvature parallel to the major axis H.

By doing this, the aforesaid problems on the mask strength and light source bending, which are aroused when the inner surface of the face panel 13 is made as flat as possible, can be solved.

The respective degrees of curvature of the long sides of the face panel 13 and the mask body 21 have a relation:

$$(\text{panel long side})<(\text{mask long side}),$$

and their sags have a relation:

$$ZPD-ZPV<ZMD-ZMV.$$

Thus, the light source bending and the meandering of the stripes of the phosphor screen 17 can be restrained by making the sags of the face panel 13 on its long sides smaller than those of the mask body 21. As this is done, the curvature of the mask body 21 on each long side is set to be substantially equivalent to that of the face panel 13 in the region from the center of the long side to the middle portion between the center of the long side and the diagonal-axis end, and be greater in the region from the middle portion to the diagonal-axis end. In the region from the center of each long side of the mask body 21 to the middle portion, therefore, the tilt angle of each electron beam passage aperture 20 is kept negative, as shown in FIG. 7, so that the curved surface strength in the peripheral part of the mask body can be improved.

A changing rate Z/L of the curved surface in the region from the central part of the face panel 13 to each axis end is given as an index of flatness. A recognition test on the flatness of the face panel 13 was conducted for a plurality of color cathode ray tubes of the aforementioned construction that were provided having various face panels with different changing rates. Thereupon, the following results were obtained.

Ten observers observed the color cathode ray tubes at a distance of 2 m therefrom under the illumination of a fluorescent lamp, and evaluated the flatness of their respective face panels according to the following criteria:

① no flatness sensed (0 point),

② some flatness sensed (1 point),

③ flatness sensed smoothly (2 points), and

④ perfect flatness sensed (3 points).

Figure 9:
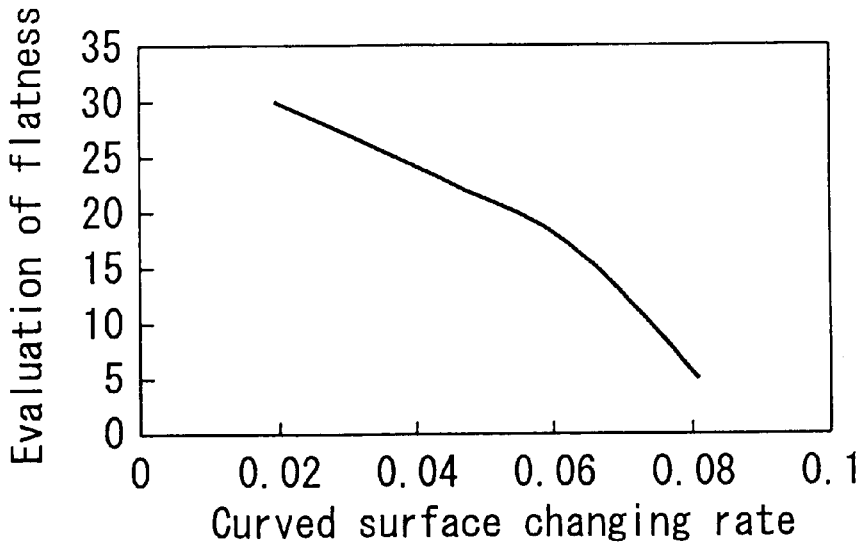
FIG. 9 is a diagram showing the relation between the evaluation of the flatness of the color cathode ray tube and the curved surface changing rate.

FIG. 9 shows the results of this evaluation test. As shown in FIG. 9, the majority of face panels with curved surface changing rates of 0.06 or less obtained 15 total points or more from the ten observers, while face panels with curved surface changing rates higher than 0.06 failed to strike the observers as flat, displaying drastic devaluation in flatness. The results shown in FIG. 9 were obtained in the case where the same curved surface changing rates were used for the three axes V, H and D.

Figure 10:
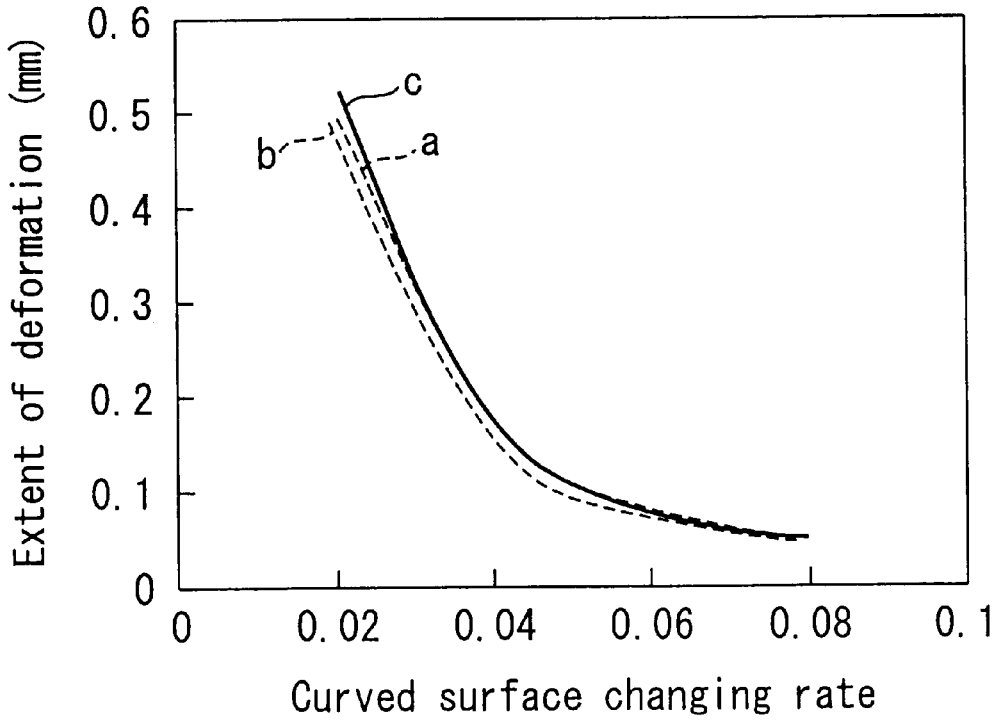
FIG. 10 is a diagram showing the relation between the curved surface changing rate and the extent of deformation of the mask body.

For the mask body 21, on the other hand, relations were determined between the extent of deformation of the mask body caused by its dead weight and the curved surface changing rates for midpoints on the individual axes, that is, a point on the minor axis V at a distance of 100 mm from the center of the mask body, a point on the major axis H at 120 mm, and a point on the diagonal axis D at 160 mm. FIG. 10 shows the results of this determination. In FIG. 10, curves a, b and c represent the relations between the curved surface changing rates and the extents of deformation on the minor axis V, major axis H, and diagonal axis D, respectively.

As seen from the diagram of FIG. 10, the curved surface changing rate of 0.025 or more is required for each axis in order to restrict the extent of deformation to about 0.4 mm or less, in consideration of conditions for curved surface formation.

Preferably, moreover, the spaces between the lines of electron beam passage apertures 20 in various parts of the mask body 21 should be restricted to about 150% of the line spaces in the central part of the mask body. In settling the sag of the face panel in accordance with the line spaces of the electron beam passage apertures 20, therefore, the curved surface changing rate for each axis must be adjusted to 0.09 or less in order to reconcile the requirements for flatness and resolution.

In order to restrain meandering of the stripes of the phosphor screen 17 that is caused by light source bending and to fulfill all the requirements for the maintenance of the implosion-proof properties and the retention of the curved surface of the mask body 21, moreover, it is desirable that the curved surface of the mask body compared to the inner surface of the face panel 13 meets the following conditions within the aforesaid range of the curved surface changing rate:

$$ZPD/LPD<ZMD/LMD,$$

$$ZPH/LPH<ZMH/LMH,$$

and $$ZPV/LPV>ZMV/LMV.$$

It is desirable that these relations are established within the following range:

$$0.020<Z/L<0.060,$$

and $$0.025<Z'/L'<0.090.$$

where ZPD/LPD, ZPH/LPH, and ZPV/LPV are represented by Z/L each, and where ZMD/LMD, ZMH/LMH, and ZMV/LMV are represented by Z'/L' each.

Thus, there may be provided a color cathode ray tube with satisfactory implosion-proof properties, which ensures those relations so that meandering of the phosphor screen 17 can be restrained to secure the curved surface strength of the mask body 21 without failing to improve the flatness of the face panel 13.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a face panel having a substantially rectangular effective portion with a substantially flat outer surface;

a phosphor screen provided on an inner surface of the effective portion;

an electron gun configured to emit electron beams to the phosphor screen; and a shadow mask located between the phosphor screen and the electron gun, the shadow mask including a mask body having a substantially rectangular effective surface opposed to the inner surface of the effective portion of the face panel and formed having a number of electron beam passage apertures, the effective portion of the face panel and the effective surface of the mask body having a major axis perpendicular to a tube axis, a minor axis perpendicular to the tube axis and the major axis, and a diagonal axis perpendicular to the tube axis, sags of the inner surface of the effective portion of the face panel in the direction of the tube axis toward the electron gun at the ends of each axis with respect to the center of the inner surface of the effective portion having relations:

$$ZPD>ZPV>ZPH,$$

where ZPD is a sag at the diagonal-axis end of the effective portion, ZPH is a sag at the major-axis end, and ZPV is a sag at the minor-axis end, sags of the effective surface of the mask body in the direction of the tube axis toward the electron gun at the ends of each axis with respect to the center of the effective surface having relations:

$$ZMD>ZMH>ZMV,$$

where ZMD is a sag at the diagonal-axis end of the effective surface, ZMH is a sag at the major-axis end, and ZMV is a sag at the minor-axis end, the sags having relations:

$$ZPD<ZMD,$$

$$ZPH<ZMH,$$

and $$ZPV>ZMV.$$

2. A color cathode ray tube according to claim 1, wherein each of the electron beam passage apertures is in the form of an elongate slit long in the direction of the minor axis, and a tilt angle $\theta_V$ of the electron beam passage apertures near the minor-axis end and a tilt angle θL of the electron beam passage apertures situated at a distance half the distance between the minor-axis end and the diagonal-axis end from the minor-axis end on the diagonal-axis end side, near the long sides of the effective surface of the mask body, have relations:

$$0 \geqq \theta_V > \theta L,$$

and the sags have a relation:

$$ZPD-ZPV<ZMD-ZMV,$$

where the tilt angle of each electron beam passage aperture to a direction parallel to the minor axis has a positive value such that each opening edge of the electron beam passage aperture on a long side of the mask body is farther from the minor axis than each opening edge of the electron beam aperture on the major axis side.

3. A color cathode ray tube according to claim 2, wherein the phosphor screen has a plurality of striped phosphor layers and black non-luminous layers extending parallel to the minor axis.

4. A color cathode ray tube according to claim 1, wherein the mask body is formed by press molding.

5. A color cathode ray tube according to claim 1, wherein the sags of the inner surface of the effective portion of the face panel and the distances from the center of the inner surface of the effective portion to the individual axis ends have a relation:

$$0.020<Z/L<0.060,$$

where Z/L represents ZPD/LPD, ZPH/LPH, or ZPV/LPV and ZMD/LMD, ZMH/LMH, and LPV representing the distances from the center of the inner surface of the effective portion to the diagonal-axis end, major-axis end, and minor-axis end, respectively, of the effective portion.

6. A color cathode ray tube comprising:

an envelope including a face panel having a substantially rectangular effective portion with a substantially flat outer surface;

a phosphor screen provided on the inner surface of the effective portion;

an electron gun configured to emit electron beams to the phosphor screen; and a shadow mask located between the phosphor screen and the electron gun, the shadow mask including a mask body having a substantially rectangular effective surface opposed to the inner surface of the effective portion of the face panel and formed having a large number of electron beam passage apertures, the effective portion of the face panel and the effective surface of the mask body having a major axis perpendicular to a tube axis, a minor axis perpendicular to the tube axis and the major axis, and a diagonal axis perpendicular to the tube axis, sags of the inner surface of the effective portion of the face panel in the direction of the tube axis toward the electron gun at the ends of each axis with respect to the center of the inner surface of the effective portion; the distances from the center of the inner surface of the effective portion to the individual axis ends; Sags of the effective surface of the shadow body in the direction of the tube axis toward the electron gun at the ends of each axis with respect to the center of the effective surface; and the distances from the center of the effective surface of the mask body to the individual axis ends have relations:

$$0.020<Z/L<0.060,$$

and $$0.025<Z'/L'<0.090,$$

where Z/L and Z'/L' represent ZPD/LPD, ZPH/LPH, or ZPV/LPV and ZMD/LMD, ZMH/LMH, or ZMV/LMV, respectively, ZPD, ZPH, and ZPV representing sags of the inner surface of the effective portion at the diagonal-axis end, major-axis end, and minor-axis end, respectively, of the effective portion of the face panel with respect to the center of the inner surface of the effective portion, LPD, LPH, and LPV representing the distances from the center of the inner surface of the effective portion to the diagonal-axis end, major-axis end, and minor-axis end, respectively, of the effective portion, ZMD, ZMH, and ZMV representing sags at the diagonal-axis end, major-axis end, and minor-axis end, respectively, of the effective surface of the mask body with respect to the center of the effective surface, and LMD, LMH, and LMV representing the distances from the center of the effective surface of the mask body to the diagonal-axis end, major-axis end, and minor-axis end, respectively, of the effective surface.

7. A color cathode ray tube according to claim 6, wherein the sags and the distances of the inner surface of the effective portion of the face panel and the sags and the distances of the effective surface of the mask body have relations:

$$ZPD/LPD<ZMD/LMD,$$

$$ZPH/LPH<ZMH/LMH,$$

and $$ZPV/LPV>ZMV/LMV.$$

8. A color cathode ray tube according to claim 6, wherein each of the electron beam passage apertures is in the form of an elongate slit long in the direction of the minor axis, and a tilt angle $\theta_V$ of the electron beam passage apertures near the minor-axis end and a tilt angle θL of the electron beam passage apertures situated at a distance half the distance between the minor-axis end and the diagonal-axis end from the minor-axis end on the diagonal-axis end side, near the long sides of the effective surface of the mask body, have relations:

$$0 \geqq \theta_V > \theta L,$$

and the sags have a relation:

$$ZPD-ZPV<ZMD-ZMV,$$

where the tilt angle of each electron beam passage aperture to a direction parallel to the minor axis has a positive value such that each opening edge of the electron beam passage aperture on a long side of the mask body is farther from the minor axis than each opening edge of the electron beam aperture on the major axis side.

9. A color cathode ray tube according to claim 8, wherein the phosphor screen has a plurality of striped phosphor layers and black non-luminous layers extending parallel to the minor axis.

10. A color cathode ray tube according to claim 6, wherein the mask body is formed by press molding.

* * * * *